US008314572B2

(12) United States Patent
Schindler et al.

(10) Patent No.: US 8,314,572 B2
(45) **Date of Patent: *Nov. 20, 2012**

(54) APPARATUS AND METHODOLOGY FOR ENHANCING EFFICIENCY OF A POWER DISTRIBUTION SYSTEM HAVING POWER FACTOR CORRECTION CAPABILITY BY USING A SELF-CALIBRATING CONTROLLER

(75) Inventors: Matthew Schindler, Redwood City, CA (US); Tushar Dhayagude, Santa Clara, CA (US); Hendrik Santo, San Jose, CA (US); Dilip Sangam, Saratoga, CA (US)

(73) Assignee: Atmel Corporation, San Jose, CA (US)

( * ) Notice: Subject to any disclaimer, the term of this patent is extended or adjusted under 35 U.S.C. 154(b) by 637 days.

This patent is subject to a terminal disclaimer.

(21) Appl. No.: 12/409,088

(22) Filed: Mar. 23, 2009

(65) Prior Publication Data

US 2009/0315467 A1 Dec. 24, 2009

Related U.S. Application Data

(63) Continuation-in-part of application No. 12/145,414, filed on Jun. 24, 2008.

(60) Provisional application No. 61/104,637, filed on Oct. 10, 2008.

(51) Int. Cl.
*H05B 37/02* (2006.01)

(52) U.S. Cl. ..... 315/307; 315/185 R; 315/297

(58) Field of Classification Search ..... 315/185 R, 315/224–226, 291, 294, 297, 307–309, 312
See application file for complete search history.

(56) References Cited

U.S. PATENT DOCUMENTS

| | | | |
|---|---|---|---|
| 5,315,214 | A | 5/1994 | Lesea |
| 5,722,040 | A | 2/1998 | Bjerede et al. |
| 6,172,556 | B1 | 1/2001 | Prentice |

(Continued)

FOREIGN PATENT DOCUMENTS

| | | |
|---|---|---|
| CN | 201114961 | 9/2008 |

(Continued)

OTHER PUBLICATIONS

International Search Report and Written Opinion for PCT Application No. PCT/US2009/053777 dated Nov. 5, 2009, 11 pages.

(Continued)

*Primary Examiner* — Tung X Le
(74) *Attorney, Agent, or Firm* — Fish & Richardson P.C.

(57) ABSTRACT

The present invention relates to circuits and methods for controlling one or more LED strings. The circuit comprises a programmable controller coupled to one or more detectors, wherein the one or more detectors are configured to detect one or more measurable parameters of one or more LEDs or LED drivers. The controller is configured to receive information from the one or more detectors related to the one or more measurable parameters and use that information to determine the desired drive voltage for the LED strings. The controller is associated with a power supply having power factor correction (PFC) capability. The controller provides the power supply with a control signal indicative of the desired drive voltage for one or more LED strings. The power supply also receives ac voltage and current waveforms as inputs and performs power factor correction and rectified waveforms related to the ac waveforms. The power supply generates the desired drive voltage based on the control signal.

20 Claims, 12 Drawing Sheets

U.S. PATENT DOCUMENTS

| | | | | |
|---|---|---|---|---|
| 6,593,709 | B2 * | 7/2003 | Lee et al. | 315/302 |
| 6,633,138 | B2 * | 10/2003 | Shannon et al. | 315/224 |
| 7,339,471 | B1 | 3/2008 | Chan et al. | |
| 7,583,035 | B2 * | 9/2009 | Shteynberg et al. | 315/307 |
| 8,044,919 | B2 | 10/2011 | Song et al. | |
| 8,072,444 | B2 | 12/2011 | Ikeda et al. | |
| 8,144,106 | B2 | 3/2012 | Kim | |
| 2002/0145041 | A1 * | 10/2002 | Muthu et al. | 235/454 |
| 2004/0105264 | A1 | 6/2004 | Spero | |
| 2005/0184708 | A1 | 8/2005 | Pipen et al. | |
| 2006/0022214 | A1 | 2/2006 | Morgan et al. | |
| 2006/0033536 | A1 | 2/2006 | Thelen et al. | |
| 2006/0214603 | A1 * | 9/2006 | Oh et al. | 315/246 |
| 2007/0040512 | A1 | 2/2007 | Jungwirth et al. | |
| 2007/0075958 | A1 | 4/2007 | Kim | |
| 2007/0091067 | A1 | 4/2007 | Elsheimer et al. | |
| 2007/0139319 | A1 | 6/2007 | Nishida et al. | |
| 2007/0273299 | A1 | 11/2007 | Miskin et al. | |
| 2007/0285133 | A1 | 12/2007 | Dickman et al. | |
| 2008/0042045 | A1 | 2/2008 | Miyazawa | |
| 2008/0084222 | A1 | 4/2008 | Yen | |
| 2008/0170012 | A1 | 7/2008 | S et al. | |
| 2008/0191631 | A1 | 8/2008 | Archenhold et al. | |
| 2008/0224629 | A1 | 9/2008 | Melanson | |
| 2008/0278097 | A1 * | 11/2008 | Roberts et al. | 315/294 |
| 2008/0309611 | A1 | 12/2008 | Yang | |
| 2009/0079362 | A1 * | 3/2009 | Shteynberg et al. | 315/294 |
| 2009/0128045 | A1 * | 5/2009 | Szczeszynski et al. | 315/185 R |
| 2009/0179589 | A1 * | 7/2009 | Buhler et al. | 315/297 |
| 2009/0184904 | A1 | 7/2009 | S. et al. | |
| 2009/0224736 | A1 | 9/2009 | Santo et al. | |
| 2009/0231247 | A1 | 9/2009 | Dhayagude et al. | |
| 2009/0267652 | A1 | 10/2009 | Santo et al. | |
| 2009/0315467 | A1 | 12/2009 | Schindler et al. | |
| 2010/0013395 | A1 * | 1/2010 | Archibald et al. | 315/185 R |
| 2010/0188443 | A1 | 7/2010 | Lewis et al. | |
| 2010/0237786 | A1 | 9/2010 | Santo et al. | |

FOREIGN PATENT DOCUMENTS

| | | | |
|---|---|---|---|
| WO | WO2009016588 | A1 | 2/2009 |

OTHER PUBLICATIONS

International Search Report and Written Opinion for PCT Application No. PCT/US2009/035334 dated Apr. 28, 2009, 10 pages.
International Search Report and Written Opinion for PCT Application No. PCT/US2009/048505 dated Jul. 31, 2009, 10 pages.
International Search Report and Written Opinion for PCT Application No. PCT/US2009/048769 dated Sep. 1, 2009, 10 pages.
International Search Report and Written Opinion for PCT Application No. PCT/US2010/061011 dated Jul. 6, 2011, 10 pages.
International Preliminary Report on Patentability for PCT/US2010/061011 dated Jul. 12, 2012, 7 pages.

* cited by examiner

APPARATUS AND METHODOLOGY FOR ENHANCING EFFICIENCY OF A POWER DISTRIBUTION SYSTEM HAVING POWER FACTOR CORRECTION CAPABILITY BY USING A SELF-CALIBRATING CONTROLLER

The present application is a continuation in part of U.S. patent application Ser. No. 12/145,414, filed Jun. 24, 2008. The present application claims priority to the provisional U.S. Patent Application No. 61/104,637, Oct. 10, 2008. The present application is related to U.S. patent application Ser. No. 12/046,280, filed Mar. 11, 2008 and U.S. patent application Ser. No. 12/111,114, filed Apr. 28, 2008, which are incorporated herein by reference in their entirety.

FIELD OF INVENTION

The present invention relates to commercial electronic display systems such as television sets and computers. Specifically, the present invention relates to techniques for enhanced and effective power distribution in commercial electronic display systems including the distribution of power to the light emitting diode (LED) strings for backlighting purposes.

BACKGROUND OF THE INVENTION

Backlights are used to illuminate liquid crystal displays ("LCDs"). LCDs with backlights are used in small displays for cell phones and personal digital assistants ("PDAs") as well as in large displays for computer monitors and televisions. Often, the light source for the backlight includes one or more cold cathode fluorescent lamps ("CCFLs"). The light source for the backlight can also be an incandescent light bulb, an electroluminescent panel ("ELP"), or one or more hot cathode fluorescent lamps ("HCFLs").

The display industry is enthusiastically pursuing the use of LEDs as the light source in the backlight technology because CCFLs have many shortcomings: they do not easily ignite in cold temperatures, they require adequate idle time to ignite, and they require delicate handling. Moreover, LEDs generally have a higher ratio of light generated to power consumed than the other backlight sources. Because of this, displays with LED backlights can consume less power than other displays. LED backlighting has traditionally been used in small, inexpensive LCD panels. However, LED backlighting is becoming more common in large displays such as those used for computers and televisions. In large displays, multiple LEDs are required to provide adequate backlight for the LCD display.

Circuits for driving multiple LEDs in large displays are typically arranged with LEDs distributed in multiple strings. FIG. 1 shows an exemplary flat panel display 10 with a backlighting system having three independent strings of LEDs 1, 2 and 3. The first string of LEDs 1 includes seven LEDs 4, 5, 6, 7, 8, 9 and 11 discretely scattered across the display 10 and connected in series. The first string 1 is controlled by the drive circuit or driver 12. The second string 2 is controlled by the drive circuit 13 and the third string 3 is controlled by the drive circuit 14. The LEDs of the LED strings 1, 2 and 3 can be connected in series by wires, traces or other connecting elements.

FIG. 2 shows another exemplary flat panel display 20 with a backlighting system having three independent strings of LEDs 21, 22 and 23. In this embodiment, the strings 21, 22 and 23 are arranged in a vertical fashion. The three strings 21, 22 and 23 are parallel to each other. The first string 21 includes seven LEDs 24, 25, 26, 27, 28, 29 and 31 connected in series, and is controlled by the drive circuit, or driver, 32. The second string 22 is controlled by the drive circuit 33 and the third string 23 is controlled by the drive circuit 34. One of ordinary skill in the art will appreciate that the LED strings can also be arranged in a horizontal fashion or in another configuration.

There are many parameters in an LED string that can be controlled to optimize the efficiency or/and other operating targets of an LED string and driver, including temperature, luminous intensity, color, current and voltage. For example, current is an important feature for displays because the current in the LEDs controls the brightness or luminous intensity of the LEDs. The intensity of an LED, or luminosity, is a function of the current flowing through the LED. FIG. 3 shows a representative plot of luminous intensity as a function of forward current for an LED. As the current in the LED increases, the intensity of the light produced by the LED increases. The current in the LEDs must be sufficiently high to meet the desired brightness requirement. The drive current of the LED string is a function of the drive voltage applied to the LED string. In conventional displays, the drive voltage for the LED strings is fixed at a higher level than necessary, often with a large margin referred to as headroom, to ensure the operation of the LED strings under the worst case physical, electrical and ambient conditions and to account for the variations in the LEDs made by various manufacturers. That results in wastage of power.

Commercial electronic display systems are generally plugged into wall outlets, which provide around 110 volts alternating current (VAC) in the United States of America and around 220 VAC in some other countries. Some of the internal electrical components of the display systems operate with ac voltages and currents, for example, transformers. However, other internal electrical components of the display systems operate with direct current (dc) voltages and currents, for example, LED strings used for backlighting purposes.

To drive the LED strings, the conventional electronic display systems first convert the ac voltages and currents received from the wall outlets into dc voltages and currents by using a rectifier circuit. One of ordinary skill in the art will appreciate that the rectifier circuit can be a half wave rectifier or a full wave rectifier. Typically, the output of the rectifier circuit is further processed by a dc to dc converter. The dc to dc converter can be a switch regulator or a linear regulator. The dc to dc converter can be a part of a power factor correction circuitry. Next, the output of the dc to dc converter is scaled, typically by using another dc to dc converter, to obtain the desired drive voltage for the LED strings. It would be desirable to reduce the number of display system components by eliminating the dc to dc scaling converter.

SUMMARY OF THE INVENTION

The present invention relates to circuits and methods for controlling one or more LEDs or LED drivers. The circuit comprises a programmable controller coupled to one or more detectors, wherein the one or more detectors are configured to detect one or more measurable parameters of the one or more LEDs or LED drivers. The controller is configured to receive information from the one or more detectors related to the one or more measurable parameters. The controller is also configured to adjust one or more controllable parameters until one or more detectors indicate that one or more measurable parameters in one of the LEDs or LED drivers meet(s) a reference condition. The controller is configured to then set one or more of the controllable parameters to operate at a value relative to the value of the controllable parameters at which the reference condition was met.

The present invention also includes a method for controlling one or more LEDs or LED drivers. The method comprises detecting one or more measurable parameters of the one or more LEDs or LED drivers, receiving information from the one or more detectors related to the one or more measurable parameters, adjusting one or more controllable parameters of the one or more LEDs or LED drivers until the measurable parameters in the one or more LEDs or LED drivers meet a reference condition, and setting the controllable parameters to operate at a value relative to the value of the controllable parameters at which the reference condition was met. The setting is performed by a programmable controller, which can be a de-centralized controller or a part of the main control system. The controller can be dedicated to a single LED string or can control more than one LED string.

The present invention provides a novel solution in which the programmable controller determines a desired drive voltage level for one or more strings of LEDs based on various parameters including, for example, a voltage value related to the upper limit of the triode region of a LED driver, and generates a control signal indicative of the desired drive voltage level. The control signal can be a current signal or a voltage signal. The control signal is provided as an input to a power supply having a power factor correction capability. The power supply also receives an alternating current (ac) voltage as an input, for example, the VAC received from a wall outlet. The power supply rectifies the ac voltage input by using a full wave rectifier or a half wave rectifier. The rectified ac waveforms are provided as inputs to a direct current (dc) to dc regulator of the power supply. The power factor correction circuitry of the power supply ensures that the rectified voltage and current waveforms that are provided as inputs to the dc to dc regulator are in phase with each other.

The output voltage of the regulator, which is a dc voltage, is used to drive the one or more LED strings. The regulator also provides the current drawn by the one or more LED strings, and the voltage and current waveforms provided by the regulator to the one or more LED strings are in phase with each other. Moreover, the power supply uses the control signal received from the programmable controller to cause the regulator to provide the desired drive voltage for the one or more LED strings. Thus, because the output of the power supply is already based on the control signal indicative of the desired drive voltage level determined by the programmable controller, no further dc to dc scaling of the output of the power supply is required. Moreover, because the programmable controller adaptively adjusts the control signal level based on any physical, electrical and ambient changes to the one or more strings of LEDs, for example, a substitution of a LED with a different LED, the present invention eliminates the need to fix the drive voltage at a high level to ensure LED string(s) operation(s) for all possible scenarios including worst case conditions.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 8:
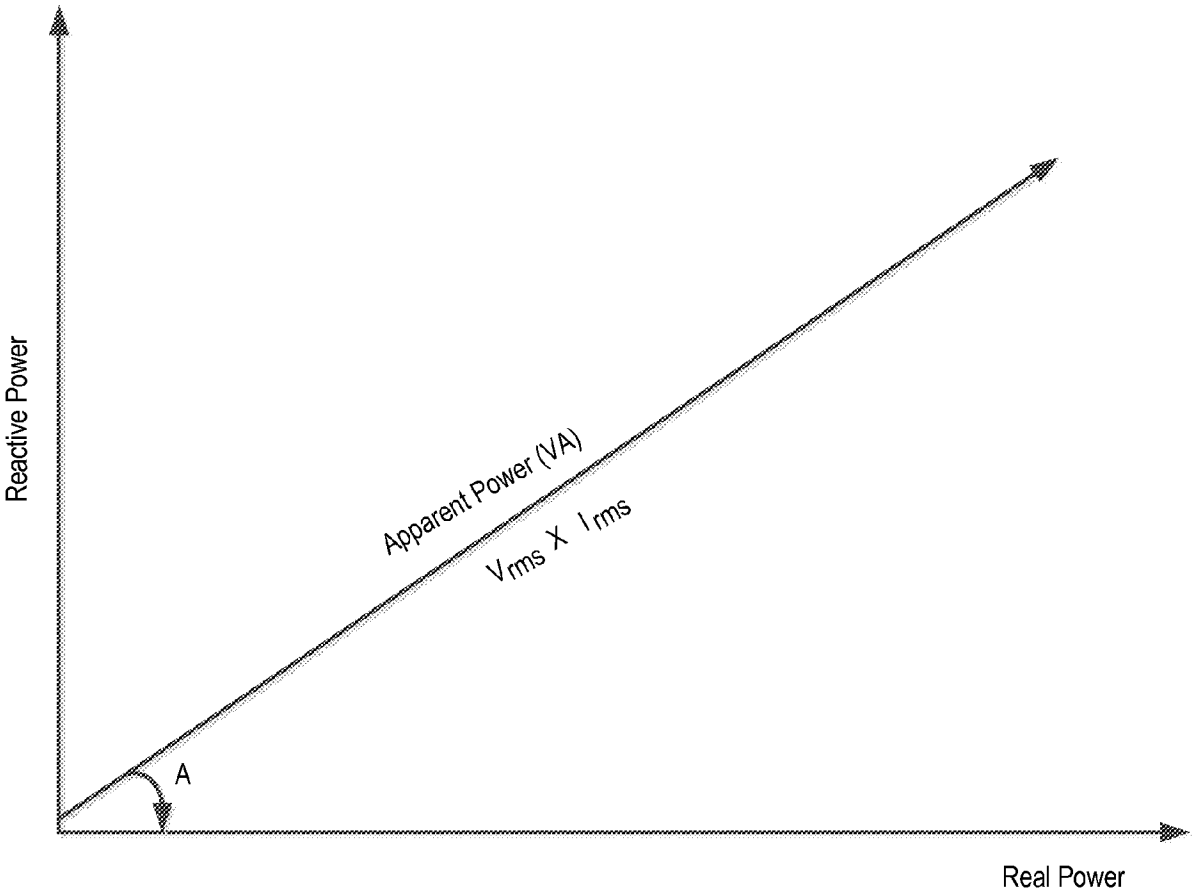
FIG. 8 illustrates an exemplary relationship between reactive, apparent and real power for an electrical power system.

The present invention relates to circuits and methods for controlling one or more LEDs or LED drivers. The luminosity of a LED is a function of the power generated by the drive voltage applied to the LED and the drive current flowing through the LED. FIG. 8 illustrates a power components relationship for an exemplary electrical power system. Specifically, FIG. 8 shows the relationship between reactive power, apparent power and real power of an electrical power system. Real power is the capacity of the circuit for performing work in a particular time. Apparent power is the product of the current and the voltage of the circuit. Due to the energy stored in the load and returned to the source, or due to a non-linear load that distorts the wave shape of the current drawn from the source, the apparent power can be greater than the real power. Power factor (PF) is the ratio of real power to apparent power and is mathematically defines as follows:

$$\text{PF}=\text{Real Power}\div\text{Apparent Power}$$

$$\text{PF}=(V_{rms}\times I_{rms}\times\text{Cosine } A)\div(V_{rms}\times I_{rms})$$

$$\text{PF}=\text{Cosine A}$$

Wherein, rms means root mean square, ÷ means division, × means multiplication, and A is the angle between apparent power and real power as shown in FIG. 8.

Figure 9:
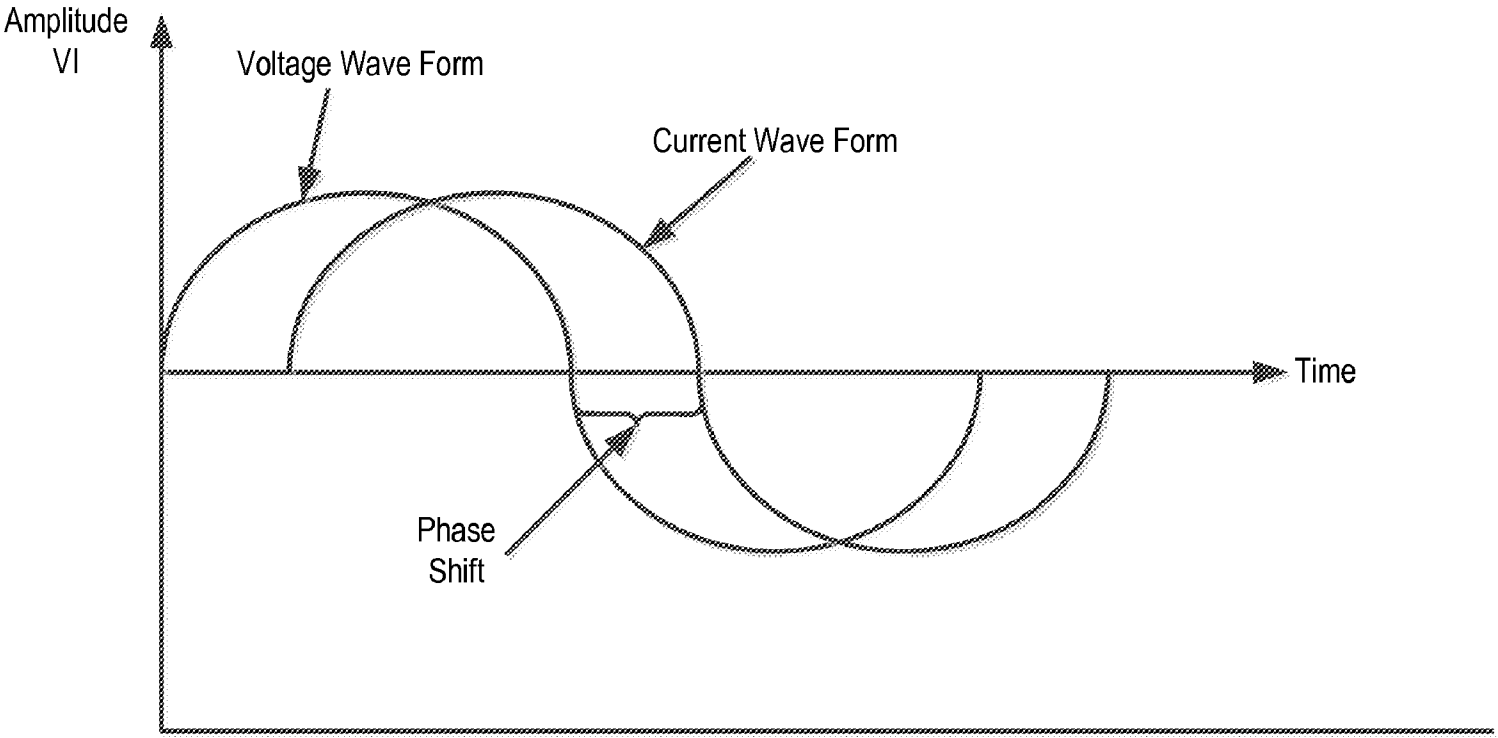
FIG. 9 illustrates an exemplary phase lag between ac voltage and current waveforms.

FIG. 9 illustrates a relationship between sinusoidal current and voltage waveforms as a function of time (t). In this relationship, the current waveform (I) lags the voltage waveform (V) by a phase difference denoted by the "Phase Shift." The "Phase Shift" shown in FIG. 9 corresponds to the angle A shown in FIG. 8. In other words, where the voltage and current waveforms are purely sinusoidal, the Power Factor is the cosine of the phase angle (A) between the current and voltage sinusoid waveforms. The Power Factor equals 1 when the voltage and current waveforms are in phase and is zero when the current waveform leads or lags the voltage waveform by 90 degrees. Ideally, a Power Factor of 1 is desired in power systems because that provides maximum power to the load.

Power Factor is a number between 0 and 1 that is frequently expressed as a percentage, for example. 0.7 PF means 70 percent power factor. In an electric power system, a load with low power factor draws more current than a load with high power factor for the same amount of useful power transferred.

The higher currents increase the energy lost in the distribution system, and require larger wires and other equipment. Because of the costs of larger equipment and wasted energy, electrical utilities will usually charge a higher cost to industrial or commercial customers where there is a low power factor.

Linear loads with low power factor (such as induction motors) can be corrected with a passive network of capacitors or inductors. Non-linear loads, such as rectifiers, distort the current drawn from the system. In such cases, active power factor correction is used to counteract the distortion and raise the power factor.

The circuit of the present invention comprises a programmable decentralized controller coupled to one or more detectors, wherein the one or more detectors are configured to detect one or more measurable parameters of one or more LEDs or LED drivers. The controller is configured to receive information from the one or more detectors related to the one or more measurable parameters. The controller is also configured to adjust one or more controllable parameters until one or more detectors indicate that one or more measurable parameters in one of the LEDs or LED drivers meet(s) a reference condition. The controller is configured to then set one or more of the controllable parameters to operate at a value relative to the value of the controllable parameters at which the reference condition was met.

The present invention also includes a method for controlling one or more LEDs or LED drivers. The method comprises detecting one or more measurable parameters of the one or more LEDs or LED drivers, receiving information from the one or more detectors related to the one or more measurable parameters, adjusting one or more controllable parameters of the one or more LEDs or LED drivers until the measurable parameters in the one or more LEDs or LED drivers meet a reference condition, and setting the controllable parameters to operate at a value relative to the value of the controllable parameters at which the reference condition was met, wherein the setting is performed by a programmable decentralized controller.

As used herein, the term "relative to" means that a value A established relative to a value B signifies that A is a function of the value B. The functional relationship between A and B can be established mathematically or by reference to a theoretical or empirical relationship. As used herein, coupled means directly or indirectly connected in series by wires, traces or other connecting elements. Coupled elements may receive signals from each other.

Figure 1:
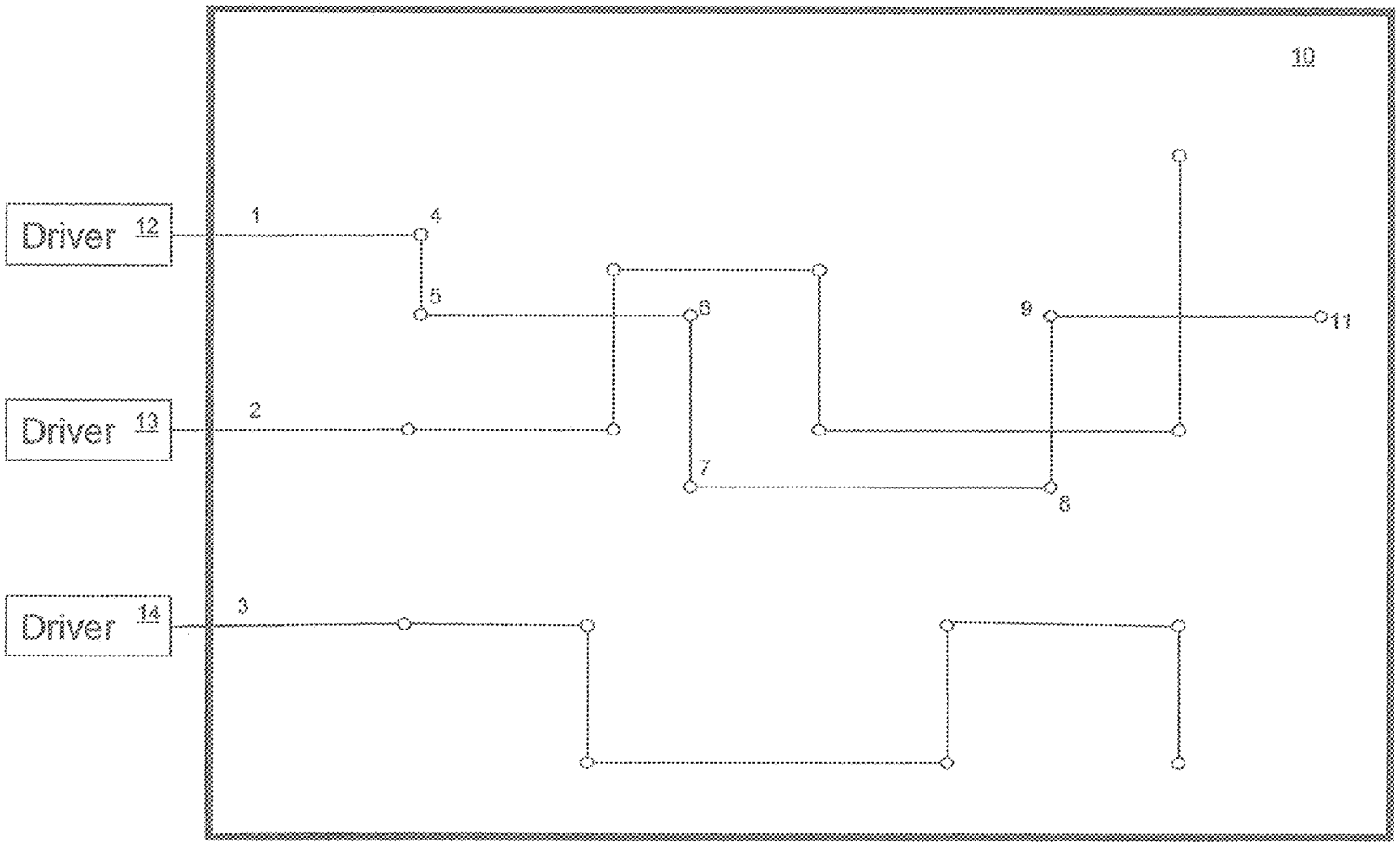
FIG. 1 illustrates an exemplary display implementing LED strings.
Figure 2:
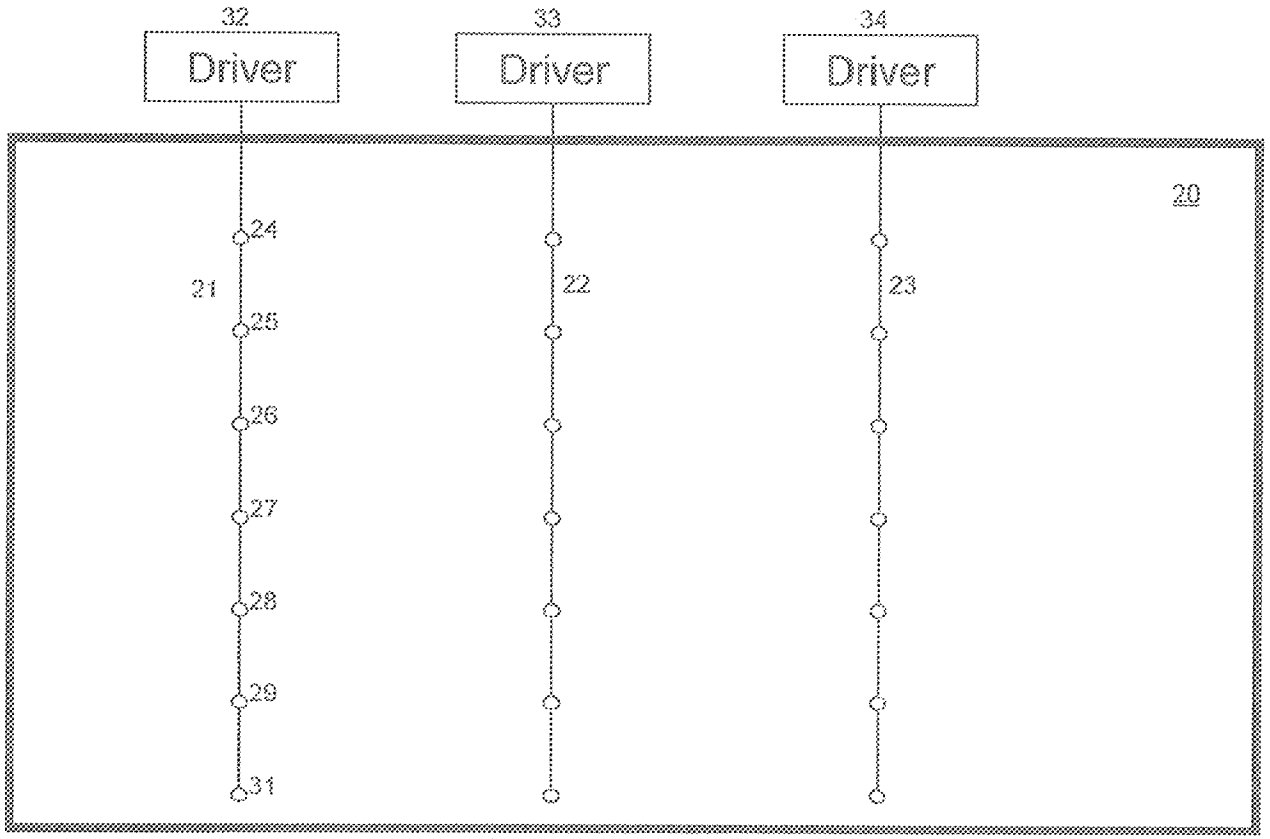
FIG. 2 illustrates another exemplary display implementing LED strings.
Figure 3:
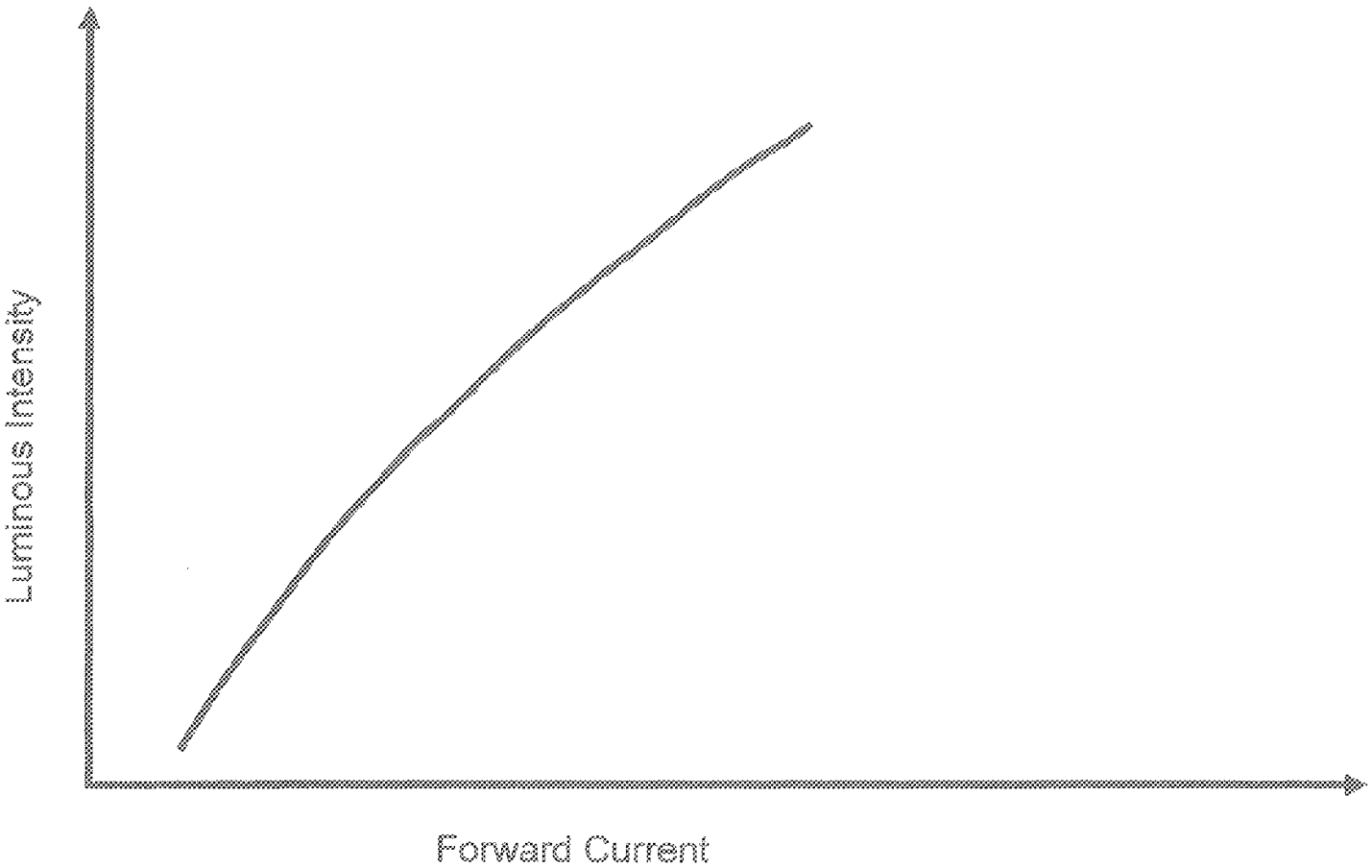
FIG. 3 illustrates a graph showing the relationship between current and luminous intensity in an LED.
Figure 4:
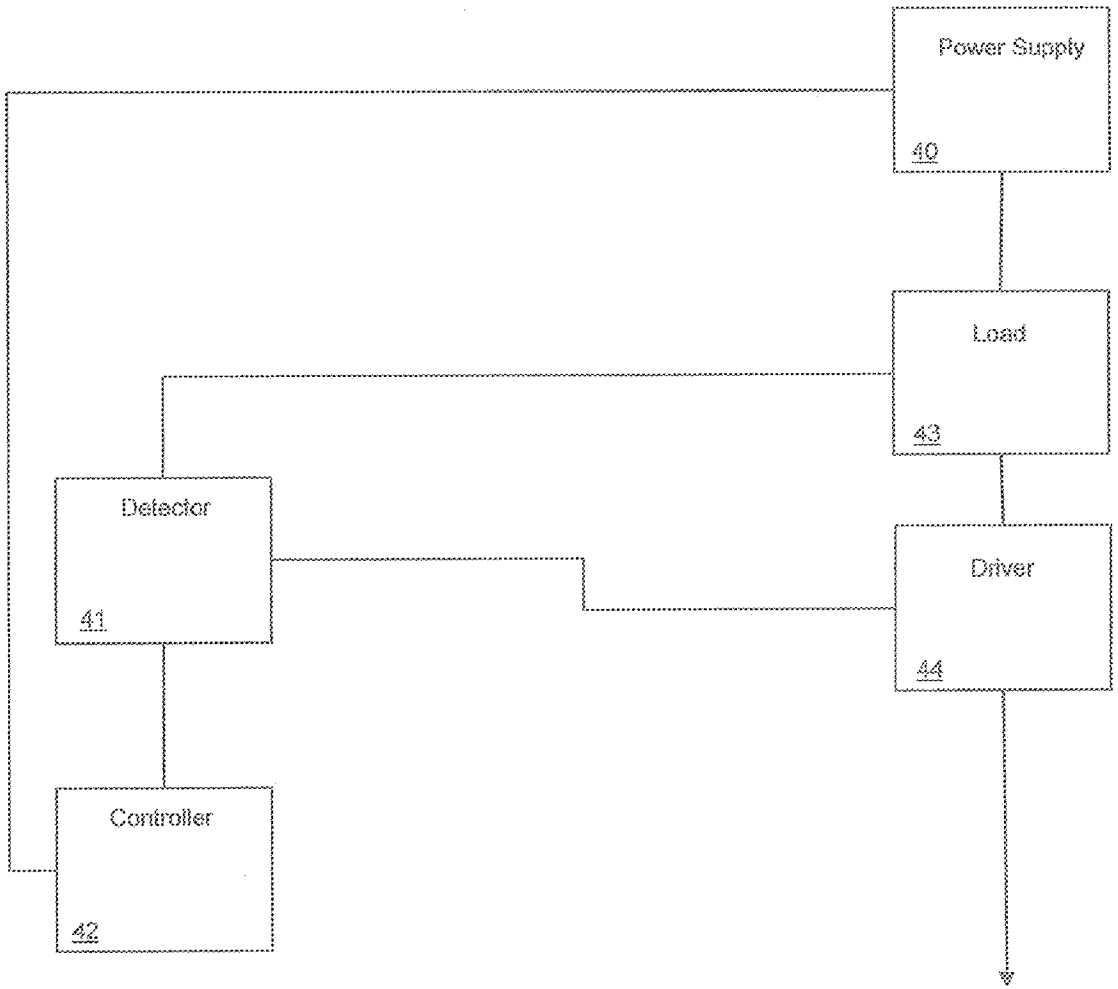
FIG. 4 illustrates an embodiment of the controller of the present invention.

FIG. 4 illustrates a configuration in which the circuit 42 for controlling at least one parameter in a load 43 or load driver 44 of the present invention can be used. The load 43 can be a string or array of LEDs and the driver 44 can be a driver for an LED string or array. In FIG. 4, a detector 41 is coupled to the load 43 and/or the driver 44. The detector 41 detects measurable parameters in the load 43 and/or driver such as temperature, voltage, current, luminous intensity, or luminous wavelength distribution or color. The triode region detector of U.S. patent application Ser. No. 12/111,114, the full disclosure of which is herein incorporated by reference, is an example of a detector 41 that can be used with the controller 42 of the present invention. The load 43 is coupled to a power supply 40 that provides the drive voltage for the LED string 43. The load 43 is also coupled to a driver 44 that regulates the operation of the load 43. The controller 42 is coupled to the power supply 40 such that the controller 42 can control the drive voltage from the power supply 40. As shown in FIG. 4, the programmable controller 42 of the present invention is decentralized. That is, the controller 42 is not a necessary part of the control loop of the power supply loop, but it can influence the power supply loop. In the example of FIG. 4, the power supply 40 can be initiated and the driver 44 can bring the load 43 to a set operating condition without any interaction from the programmable decentralized controller 42. Therefore, the driver loop comprising the power supply 40, the load 43, and the driver 44 can operate independently of the controller 42. However, at the occurrence of some event or the passage of some interval, the programmable decentralized controller can adjust the operation of the driver loop to calibrate and/or optimize a parameter of the driver loop.

In the following example, the detector 41 is a triode region detector, for example, the triode region detector disclosed in U.S. patent application Ser. No. 12/111,114. However, this is merely exemplary and is not limiting. In the case where the detector 41 is a triode region detector coupled to an LED driver 44, the controller 42 is configured to control the driver 44 and/or the power supply 40 to step the drive voltage down until the triode region detector 41 sets the triode region flag. The controller 42 then causes the power supply 40 and or the driver 44 to operate at a drive voltage some programmable level above the drive voltage at which the triode flag was set. The controller 42 causes the power supply 40 and/or the driver 44 to set the drive voltage sufficiently high to avoid operation in the triode region, thereby optimizing power dissipation in the circuit and improving circuit efficiency.

In the above example, the controller 42 causes the power supply 40 and/or the driver 44 to step down the drive voltage. However, the controller 42 can also cause the power supply 40 and/or the driver 44 to step up the drive voltage according to the desired application for the controller 42. Also, the controller 42 can control some other controllable parameter such as current, power, or resistance depending on the application. Also, in addition to the controller 42 causing the drive voltage to step up or step down, the controller 42 can wait until the drive voltage or other controllable parameter is increased or decreased until a reference condition is met. Moreover, in the above example, the controller 42 causes the power supply 40 and/or the driver 44 to set the drive voltage sufficiently high to avoid operating in the triode region. Depending on the application of the controller 42, the controller 42 can cause the power supply 40 and/or the driver 44 to set the drive voltage at any point relative to drive voltage at which the reference condition, as detected by the detector 41, is met. The reference condition can be a constant offset from the detected parameter such that the reference condition is met when the detected parameter is within a positive or negative constant from some reference for the detected parameter. The reference condition can be a function of the detected parameter and a reference parameter. The reference condition can also be a function of multiple measured parameters such as a combination of voltage, wavelength and intensity.

Figure 5:
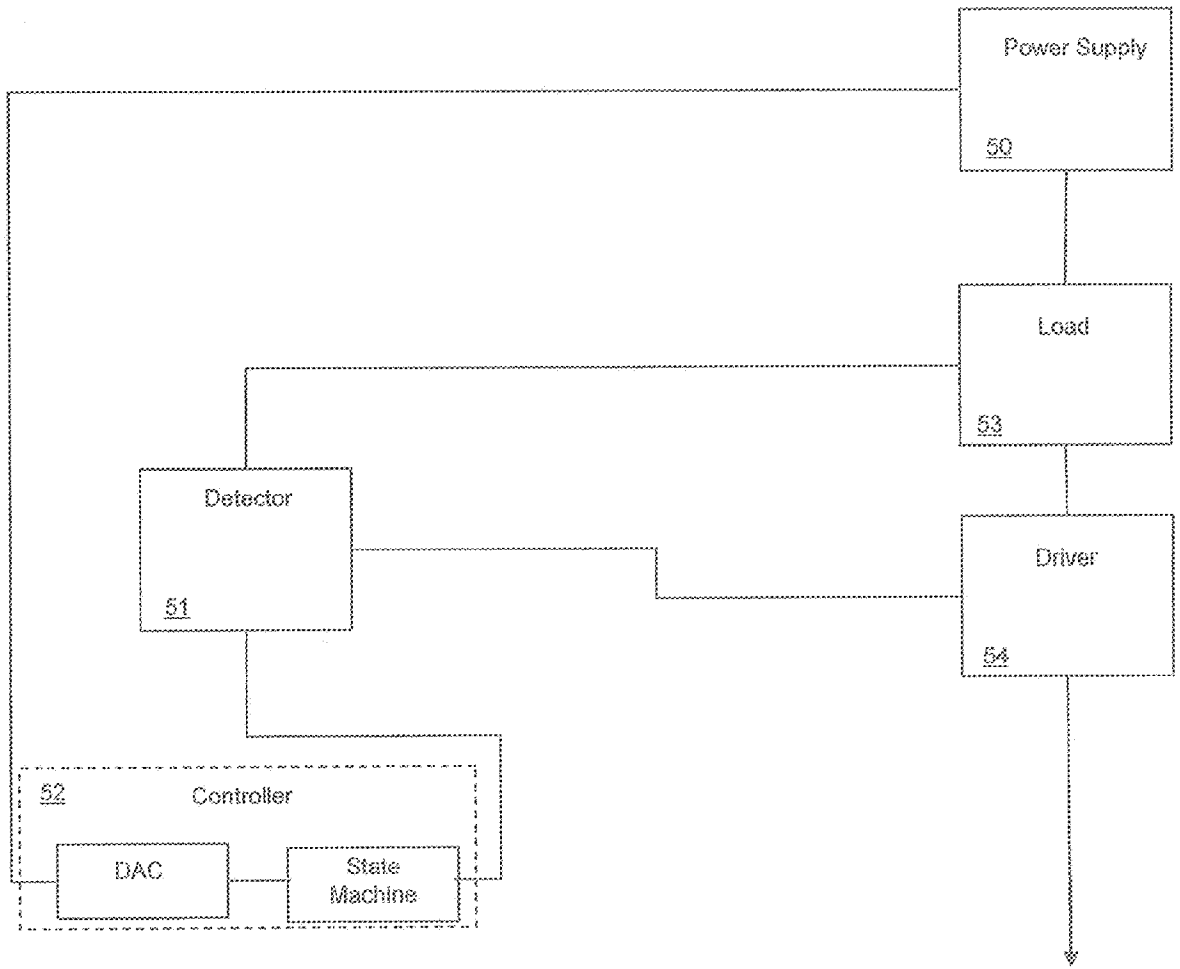
FIG. 5 illustrates an embodiment of the controller of the present invention.

As show in FIG. 5, the controller 52 can comprise a digital-to-analog converter ("DAC") and a state machine in one embodiment. The programmable controller of the present invention can be programmable and may be implemented in analog, digital or some combination of these devices and in hardware, software, firmware, or some combination of these media. The detector 52, the power supply 50, the load 53 and the driver 54 can be structurally and functionally same or similar to their counterparts in FIG. 4 41, 40, 43 and 44 respectively.

Figure 6:
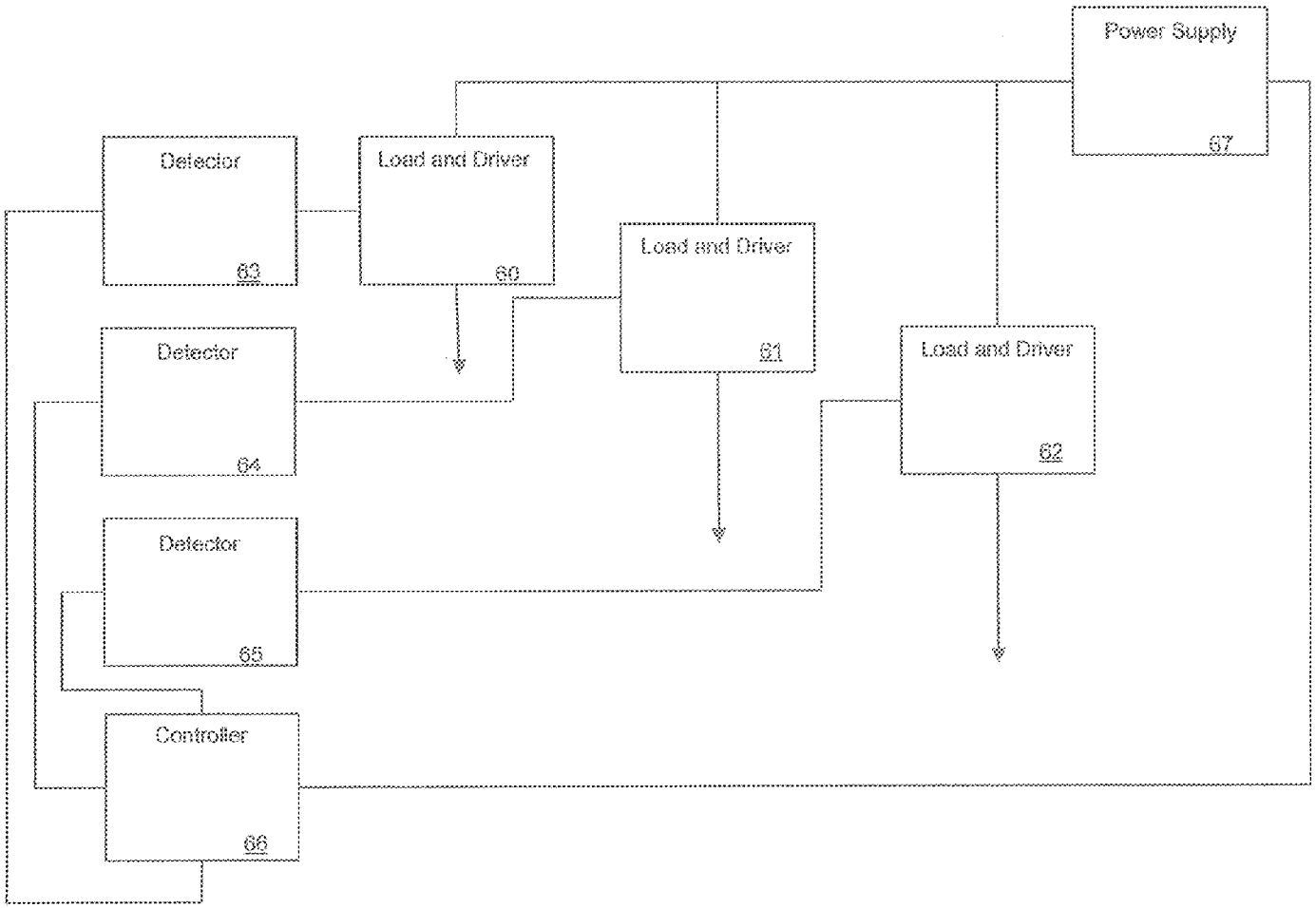
FIG. 6 illustrates an embodiment of the controller of the present invention.

As shown in FIG. 6, the programmable decentralized controller 66 can be coupled to one or more detectors 63, 64, 65 which are coupled to one or more loads and drivers 60, 61, 62. In this embodiment, the power supply 67 is coupled to one or more loads and drivers 60, 61, 62. The controller 66 operates as discussed above, causing the power supply 67 and/or the drivers 60, 61, 62 to adjust a controllable parameter until at least one of the detectors 63, 64, 65 detects that a reference condition is met in the loads and/or drivers 60, 61, 62 to which the detector is coupled. The controller 66 can cause the power supply 67 and/or drivers 60, 61, 62 to operate at a setting of the controllable parameter relative to the value of the controllable parameter at which the reference condition in at least one of the loads or drivers 60, 61, 62 was met. The trigger that the controller 66 uses to cause the power supply 67 and/or drivers 60, 61, 62 to set the controllable parameter can be detection that the reference condition is met in one of the loads or drivers 60, 61, 62 or the trigger can be some combination of the reference condition being met in more than one of the loads or drivers 60, 61, 62. The controller 66 can be programmed to induce a delay between the time the reference condition in one or more of the loads or drivers 60, 61, 62 is met and the time the controllable parameter is set.

Figure 7:
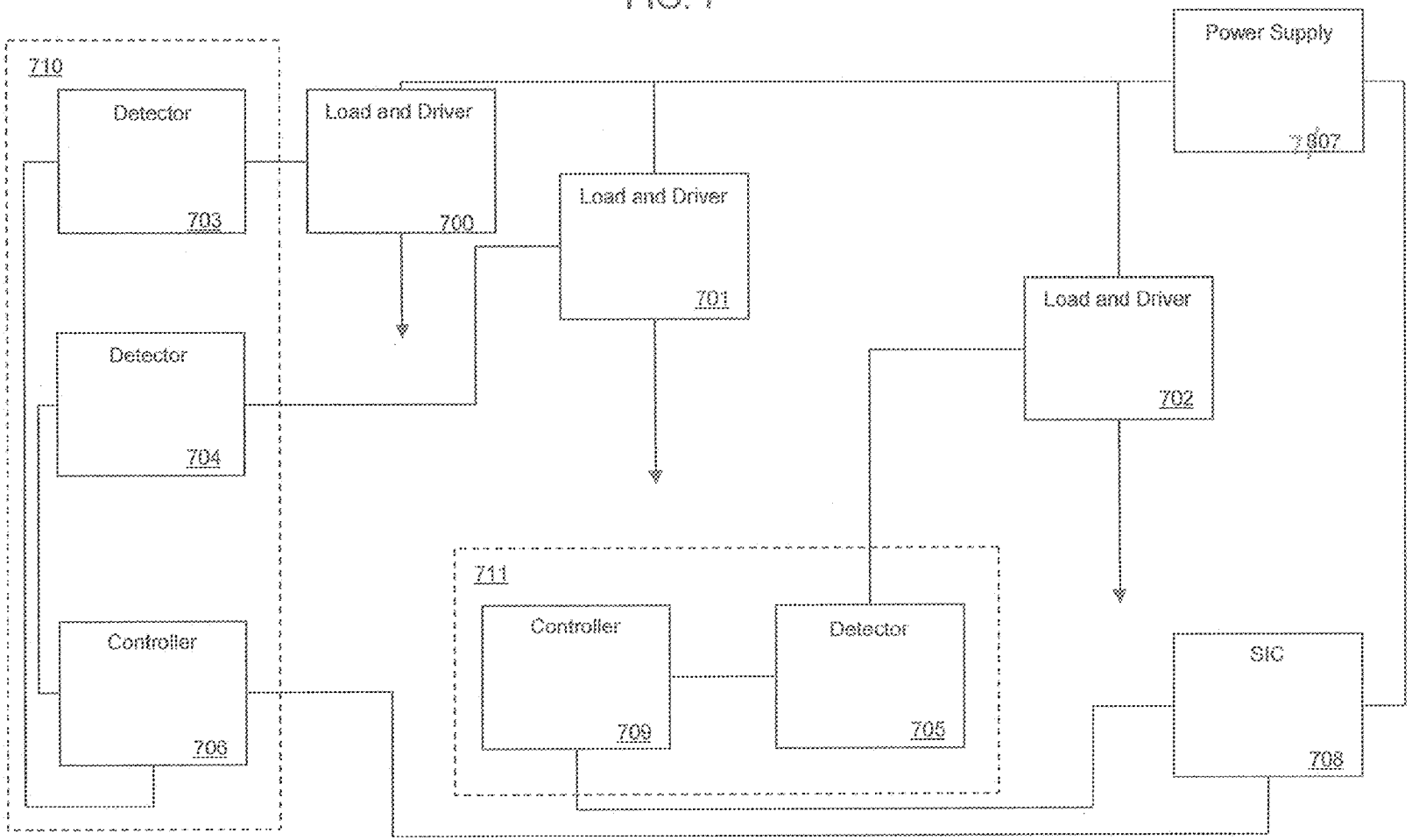
FIG. 7 illustrates an embodiment of the controller of the present invention.

As shown in FIG. 7, the controller 706 of the present invention can be used in conjunction with one or more other controllers 709. In the example of FIG. 7, an integrated circuit chip 710 comprises the controller 706 and detectors 703, 704. The integrated circuit chip 710 can also comprise a controller 709, a detector 705, and a driver 702. In an alternate embodiment, a second integrated circuit chip 711 can comprise the controller 709 and the detector 705. The detectors 703, 704, 705 are coupled to loads and drivers 700, 701, 702 respectively. The loads and drivers 700, 701, 702 are coupled to a power supply 707. The controllers 706, 709 can be coupled to a system for inter-chip communication ("SIC") 708 such as that disclosed in U.S. patent application Ser. No. 12/046,280, the entire disclosure of which is herein incorporated by reference. When the detectors 703, 704, 705 detect that a reference condition is met in one of the respective loads and/or drivers 700, 701, 702, or in some combination of the respective loads and drivers 700, 701, 702, at least one of the controllers 706, 709 causes the power supply 707 to set the controllable parameter in the loads and drivers 700, 701, 702.

The controller 42, 52, 66 or 706 of the present invention, which can be integrated in a liquid crystal display having LEDs, can set one or more controllable parameters at some regular or adjustable interval or upon certain events such as at initial start up to or upon a change in some measurable system parameter. The controller 42, 53, 66 or 706 can also initiate the adjusting of the controllable parameters relative to a change in an additional measurable system parameter in at least one of the one or more loads and/or drivers. The additional measurable parameter can be the same as the measurable parameter that is detected by the detectors, or it can be a different measurable parameter.

Figure 10:
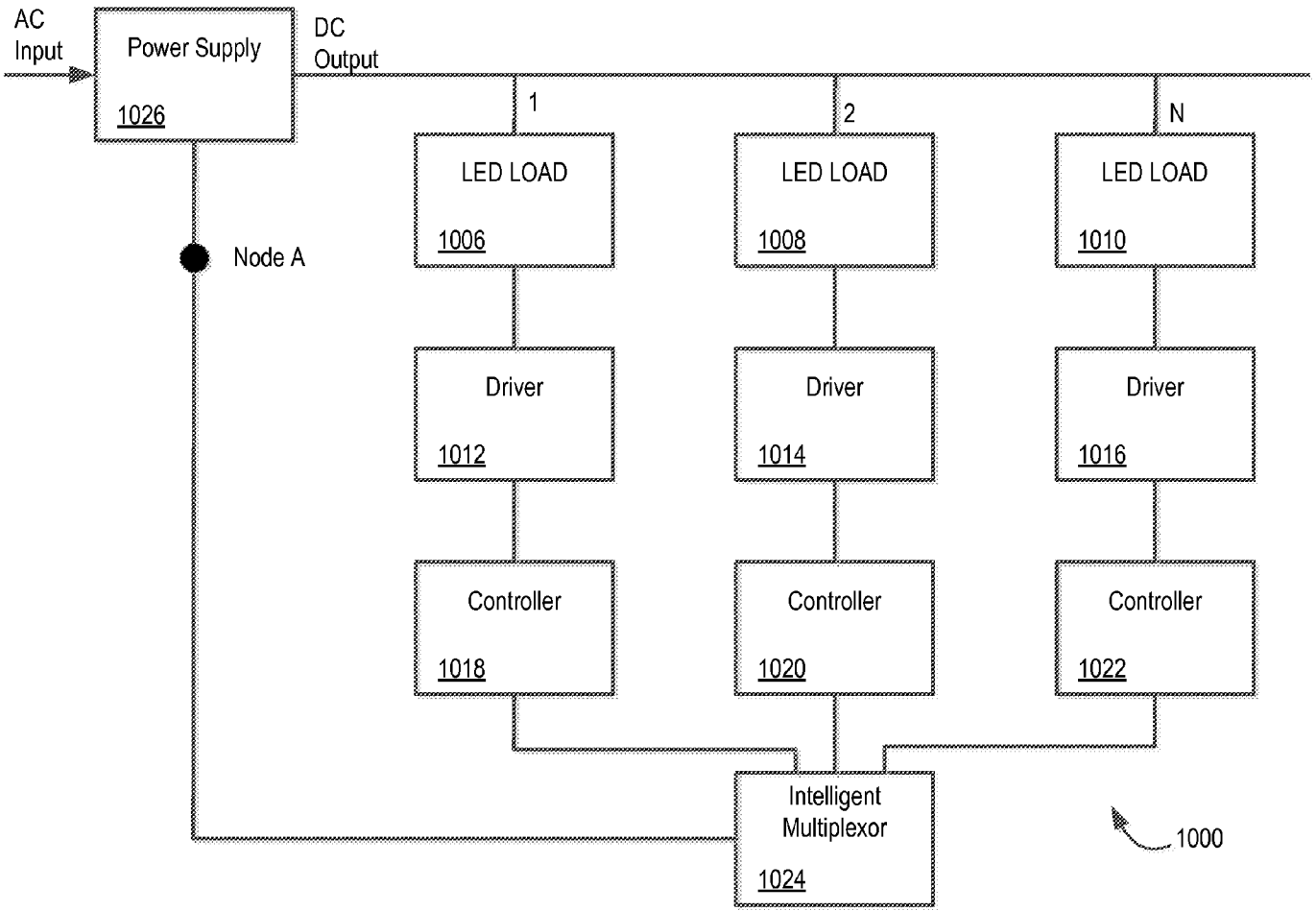
FIG. 10 illustrates an exemplary system embodiment of the present invention.

FIG. 10 illustrates a functional block diagram for an exemplary system 1000 of the present invention. The system 1000 can be implemented in a liquid crystal display, for example, and can be used to control the LED strings used for backlighting. One of ordinary skill in the art will appreciate that the application of the system 1000 is not limited to LED loads and that other loads involved in television and lighting applications are also applicable to the system 1000. One of ordinary skill in the art will also appreciate that the system 1000 is not limited to display applications and can be used for other applications, for example, for LED street lighting.

The system 1000 includes a power supply 1026 having power factor correction capability. The power supply 1026 provides the drive voltage to multiple strings of LEDs 1, 2 and n. The power supply 1026 can be implemented by using one or more integrated circuit (IC) chips. The LEDs 1006 of string 1 are coupled to a LED driver 1012 and a controller 1014. The LEDs 1008 of string 2 are coupled to a LED driver 1014 and a controller 1020. The LEDs 1010 of string n are coupled to a LED driver 1016 and a controller 1022. The driver 1012, 1014 or 1016 can include a field effect transistor for controllably providing a current path from the power supply 1002 to the ground by way of the LED string 1, 2 or n respectively. The controller 1018, 1020 or 1022 can be representative of the controller 42, 53, 66 or 706 and can also be referred to as an efficiency optimizer because one of its purposes is to optimize the efficiency of the LED string 1, 2 or n respectively.

The controller 1018, 1020 or 1022 can be a part of a centralized controller that controls the operation of the LED strings 1, 2 and n, or an independent de-centralized controller that can influence the operation of the LED strings 1, 2 and n but is not a part of the centralized controller. The controllers 1018, 1020 and 1022 can be situated on the same integrated circuit chip or different integrated circuit chips.

As discussed above, the controllers 1018, 1020 and 1022 receive inputs from one or more detectors indicative of the operations of their respective strings 1, 2 and n, or, of the ambient conditions proximate to their respective strings 1, 2 and n. One such input can include the triode region voltage detection. The triode region refers to an operation state of a LED string 1, 2 or n in which the current flowing through the LED string 1, 2 or n increases as a direct result of an increase in the drive voltage supplied by the power supply 1002. Outside the triode region, the increase in the drive voltage supplied by the power supply 1002 does not directly change the current flowing through a LED string 1, 2 or n. The upper voltage limit of the triode region represents the minimum drive voltage that is required to drive a LED string 1, 2 or n properly.

In one embodiment of the present invention, the controllers 1018, 1020 and 1022 are coupled to the power supply by way of an intelligent multiplexer 1018. In another embodiment of the present invention, the controllers 1018 and 1020 and 1022 are coupled to the power supply 1026 without using the multiplexer 1018. In the embodiment that uses the multiplexer 1018, the purpose of the multiplexer 1018 is to provide additional flexibility in the interaction between the power supply 1026 and the controllers 1018, 1020 and 1022. For example, the multiplexer 1018 can sequence the timing of interaction of the various strings 1, 2 and n with the power supply 1026 or can allow only certain strings 1, 2 or n to interact with the power supply 1026.

The power supply 1026 is typically available in power supplies of television sets and other electronic systems and the system 1000 of the present invention can intelligently and adaptively optimize the drive needs of the LED strings 1, 2 and n by transparently inheriting the benefits of the power supply available in a television set in which the system 1000 is implemented, for example. For example, the system 1000 can be coupled to the power supply 1026 at Node A shown in FIG. 10. The power supply 1026 receives an AC power input, for example, from a wall outlet, and an input from the system 1000 at Node A, and provides a DC power output to the LED strings 1, 2 and n.

In the present invention, a control signal representative of the desired drive voltage for the LED string 1, 2 and n is injected at Node A. The control signal can include, for example, a current signal representative of the upper limit of the triode region voltage for the lead string. The lead string can include the LED string 1, 2 or n that has the highest upper limit of the triode region voltages of all the LED strings 1, 2 and n. The controller 1018, 1020 or 1022 of the present invention can monitor the triode region voltage limit for the various LED strings 1, 2 and n from time to time, for example, upon initialization and periodically thereafter. The present invention thus provides for efficient power management by allowing the system 1000 to only provide the necessary drive voltage and by eliminating the need for any dc to dc scaling of the output voltage of the power supply 1026. In the conventional systems, drive voltages much higher than the upper limit of the triode region voltage provided, to provide adequate headroom, to account for worst case LED manufacturing variations and physical changes in the LED strings that can occur with time and temperature including replacement of damaged LEDs with different LEDs. Moreover, in the conventional systems, an intermediate dc to dc power supply is placed between the power supply 1026 and the LED strings 1, 2 and n to scale the output of the power supply 1026 into the drive voltage for the LED strings. The present invention eliminates the need for the intermediate dc to dc power supply because the power supply 1026 provides the desired drive voltage based on the control signal provided at Node A. The controllers 1018, 1020 and 1022 of the present invention provide for on-the-fly adjustments to the drive voltages by evaluating the triode region limits from time to time and by eliminating the intermediate dc to dc scaling converter that is conventionally placed between the power supply 1026 and the LED strings 1, 2 and n. The elimination of the intermediate dc to dc scaling converter provides savings in terms of circuitry components and power and also provides for adaptive power adjustments to the LED strings. The present invention thus reduces the wastage of power and enhances the effectiveness and efficiency of the power distribution system.

The multiplexor 1024 provides the power supply 1026 with a current signal (or alternately a voltage signal) indicative of the desired power supply voltage for driving the LED strings 1, 2 and n. Power supplies with built in power factor correction modules are generally available inside television sets and other consumer display systems. For example, the UC3854 integrated circuit chip made by the Unitrode Corporation and the LT1249 integrated circuit chip made by the Linear Technology Corporation provide power correction circuitry and are used in television sets. Node A of the system 1000 of the present invention can be coupled to Pin Number 11 of the UC3854 chip (Vsense Pin) and Pin Number 6 of the LTI249 chip (Vsense Pin).

Figure 11:
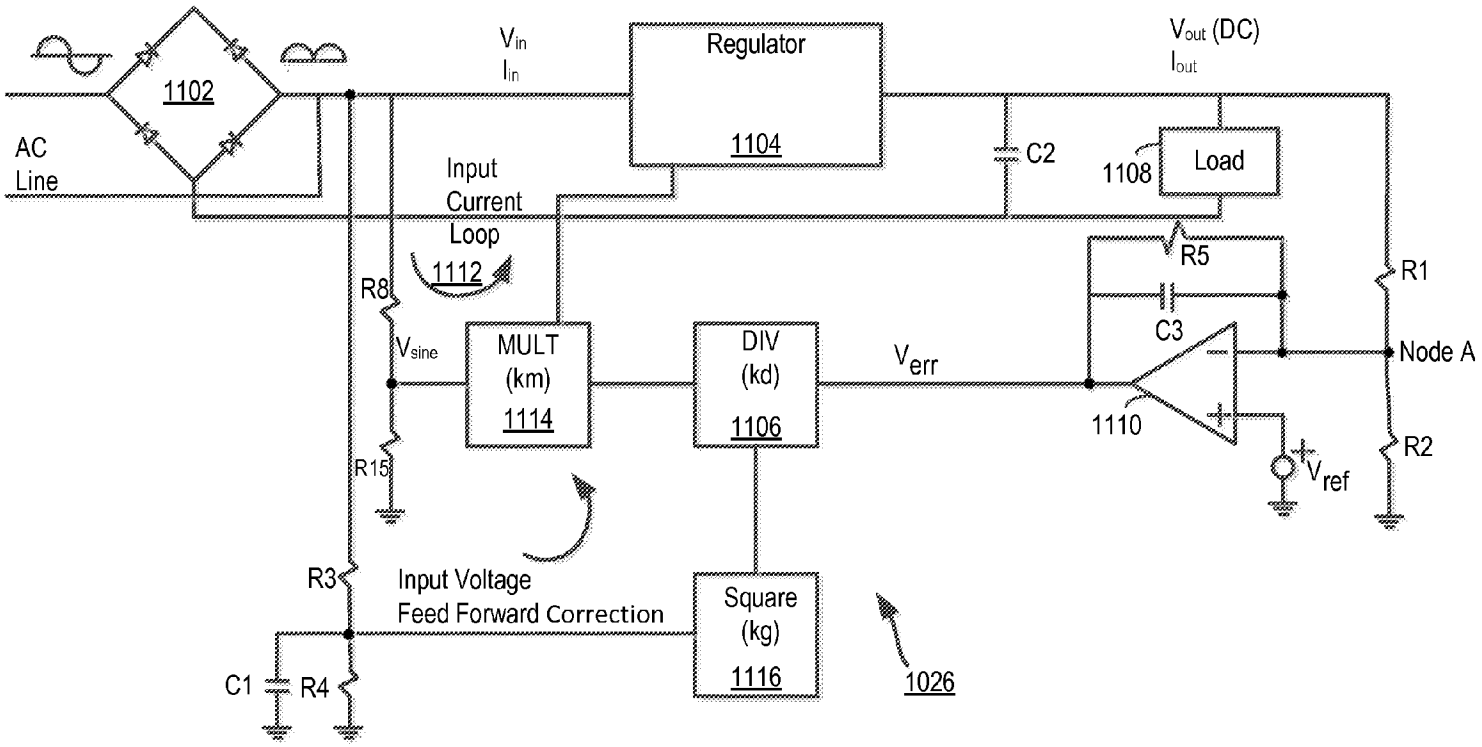
FIG. 11 illustrates another exemplary system embodiment of the present invention.

FIG. 11 illustrates an exemplary embodiment of the power supply 1026 illustrated in FIG. 10. The exemplary power supply 1026 shown in FIG. 10 uses a boost regulator 1104. One of ordinary skill in the art will appreciate that power supplies with buck, boost, flyback forward and other power converters are available in the marketplace and are applicable to the present invention. The power supply 1026 of FIG. 11 includes an input current control loop 1112 consisting of the boost power converters 1104, the multiplier 1114 and the resistors R8 and R15. An alternate current (AC) voltage line is coupled to a full wave rectifier 1102 and serves as an input to the power supply 1026. The full wave rectifier 1102 is coupled to the resistors R8 and R15. The full wave rectifier 1102 generates a full wave rectified sine wave voltage signal Vin. The boost switching regulator 1104 can force the line current (Iin) to following the envelope of the line voltage (Vin) and go in phase with it.

The output of the multiplexor 1024 can be coupled to the inverting input of the operational amplifier 1110. In the alternative, the output of the controller 1018, 1020 or 1022 can be coupled to the inverting input of the operational amplifier 1110. The current signal provided by the controller 1018, 1020 or 1022 or the multiplexor 1024 at Node A to the inverting input of the operational amplifier 1110 is indicative of the desired drive voltage of the LED strings 1, 2 and n. The non-inverting input of the operational amplifier 1110 is coupled to a reference voltage.

The output of the operational amplifier 1110 is coupled to the multiplier 1114. The operational amplifier 1110 provides the signal Verr to the multiplier 1114. The multiplier 1114 multiplies the Verr voltage signal with the Vsine voltage signal. The Vsine voltage signal is a full wave rectified sine wave voltage signal which results from drop in voltage of Vin caused by the resistors R8 and R15. The current generated by the input current control loop 1112 is proportional to the Verr voltage multiplied by Vsine voltage. The dc to dc converter 1104 provides the load 1108 with a drive voltage Vout and drive current Iout that is generated by using the control signal input received from the efficiency optimizer 1018, 1020 or 1022. The LED strings 1, 2 and n illustrated in FIG. 10 can be represented by the load 1108 in FIG. 11.

The present invention provides an advantage over the conventional power factor correction systems because it directly uses the output of the efficiency optimizer 1018, 1020 or 1022 to drive the LED strings 1, 2 and n. In conventional power factor correction systems, an intermediate direct current (dc) to direct current (dc) power regulator interfaces with the PFC power supply to adjust the output voltage of the PFC power supply to a higher level to provide the LED strings with the worst case scenario drive voltage that is high enough drive a wide range of LEDs over production variations and operations in terms of time, temperature and other factors. In that scenario, the central controller communicates the desired drive voltages to the regulator. Thus, in the conventional systems, the output of the power factor correction circuitry is adjusted to provide the desired drive voltages and currents. In the systems and methods of the present invention, the input to the power supply 1026 can be adjusted by the efficiency optimizer 1018, 1020 or 1022 to provide the desired drive voltages and currents to the LED strings 1, 2 and n. The resistors R3 and R4 and the square block 1116 and the division block 1106 form the line variation correction loop. One of ordinary skill in the art will appreciate that the techniques of the present invention can be applied to wide ranging power supplies that are available in commercial display systems and that the power supply 1026 illustrated in FIG. 11 is merely an exemplary one.

Figure 12:
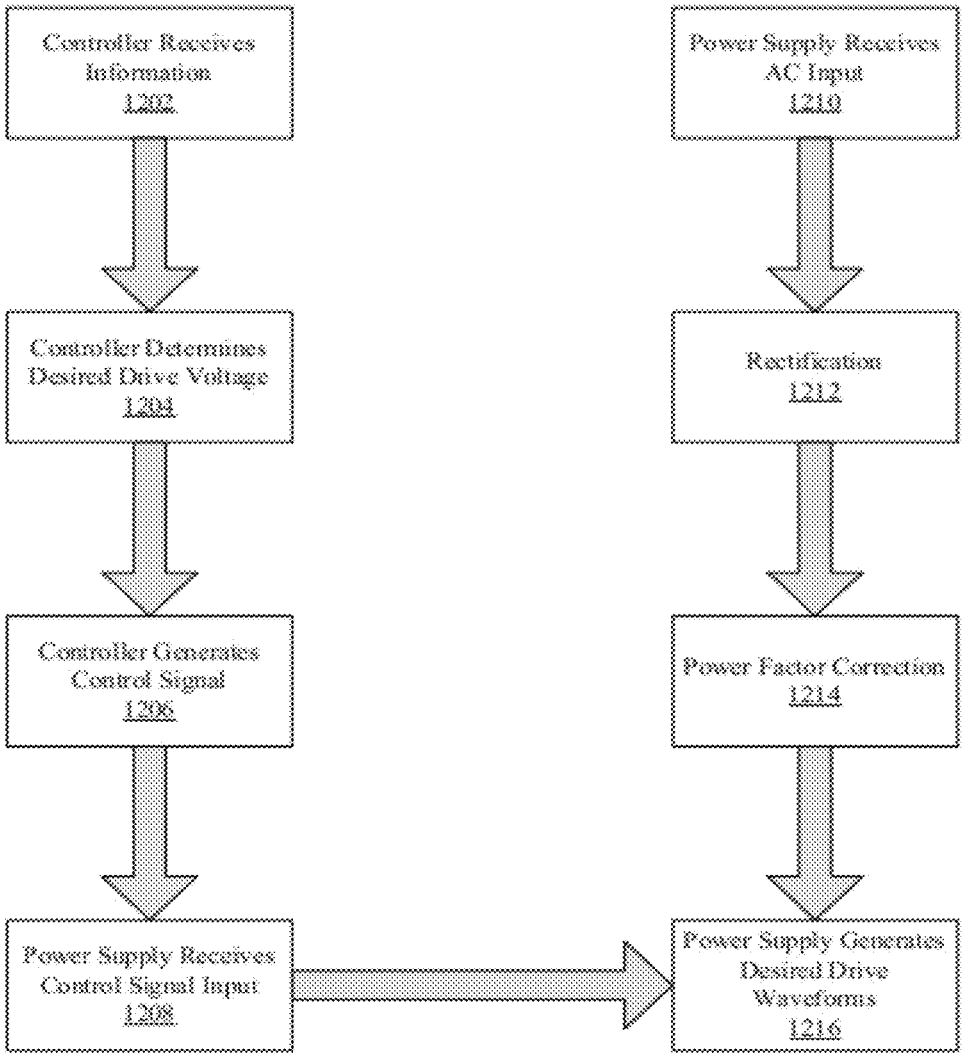
FIG. 12 illustrates an exemplary flow chart of a method of the present invention.

FIG. 12 illustrates a flow chart of an exemplary methodology of the present invention. At block 1202, the programmable controller of the present invention receives information from one or more detectors, for example, a triode region detector. At block 1204, based upon the information received from the one or more detectors, the programmable controller determines the desired drive voltage level for one or more LED strings. At block 1206, the programmable controller generates a control signal indicative of the desired drive voltage level. At block 1208, the control signal is provided as an input to a power supply having a power factor correction capability. One of ordinary skill in the art will appreciate that the control signal also includes a signal that is a variation of the control signal or a signal related to the control signal.

At block 1210, the power supply receives an ac power input including ac voltage and current waveforms. At block 1212, a rectifier circuit rectifies the ac voltage and current input waveforms. At block 1214, the power supply causes power factor correction of the rectified waveforms and thereby causes the rectified voltage and current waveforms to be in phase with each other. At block 1216, the power supply uses the in phase waveforms and the control signal to generate the desired drive voltage and current waveforms for the one or more LED strings. Thus, according to the exemplary methodology illustrated in FIG. 12, the power supply of the present invention can receive two inputs that can be processed in parallel independently of each other: a control signal input at block 1208 and an ac input at block 1210.

One of ordinary skill in the art will appreciate that the techniques, structures and methods of the present invention above are exemplary. The present invention can be implemented in various embodiments without deviating from the scope of the invention.

The invention claimed is:

1. A circuit for controlling one or more light emitting diode (LED) strings comprising:

a detector coupled to one or more LED strings and a programmable controller, wherein the detector is capable of: detecting a first measurable parameter of the one or more LED strings;

the programmable controller that:

receives information from the detector related to the first measurable parameter; and based on the received information, adjusts one or more controllable parameters of the one or more LED strings until receiving an indication from the detector that the first measurable parameter meets a reference condition, wherein adjusting one or more controllable parameters includes using the information to determine a desired drive voltage level value, and generating a control signal indicative of the desired drive voltage value; and a power supply having a power factor correction capability that: receives the control signal as a first input; receives an AC voltage waveform as a second input; and generates a drive voltage based on the control signal.

2. The circuit of claim 1, wherein the detector includes a detector for detecting an upper limit of a triode region voltage range.

3. The circuit of claim 1, wherein the detector includes a detector for detecting an ambient temperature of a LED string.

4. The circuit of claim 1, wherein the detector includes a detector for detecting a luminous intensity of a LED.

5. The circuit of claim 1, wherein the detector includes a detector for detecting a wavelength of a light emitted by a LED.

6. The circuit of claim 1, wherein the programmable controller generates the control signal relative to a start up of at least one of the one or more LED strings.

7. The circuit of claim 1, wherein the programmable controller generates the control signal relative to a change in a second measurable parameter in at least one of the one or more LED strings.

8. The circuit of claim 1, wherein the programmable controller generates the control signal based at least in part on at least one of a fixed time interval or a variable time interval.

9. The circuit of claim 1, wherein the programmable controller comprises a digital-to-analog converter (DAC) and a state machine.

10. The circuit of claim 1, further comprising:

a liquid crystal display, wherein the circuit is implemented in the liquid crystal display.

11. A method for controlling one or more LED strings comprising:

detecting a first measurable parameter of one or more LED strings;

receiving information related to the first measurable parameter; and based on receiving the information, adjusting one or more controllable parameters of the one or more LED strings until receiving an indication that the first measurable parameter meets a reference condition, wherein adjusting one or more controllable parameters includes:

generating a control signal indicative of a desired drive voltage for the one or more LED strings based on the information, performing a power factor correction related to AC current and AC voltage waveforms inputs for a power supply, and causing the power supply to generate the desired drive voltage based on the control signal.

12. The method of claim 11, wherein the control signal includes a current signal.

13. The method of claim 11, wherein performing the power factor correction includes causing the current waveform to be in phase with the voltage waveform.

14. The method of claim 11, wherein the first measurable parameter is selected from a group comprising ambient temperature of a LED, current flowing through a LED, voltage across a LED, luminous intensity of a LED, and a wavelength of light emitted by a LED.

15. The method of claim 11, wherein the generating of the control signal is initiated relative to a start up of at least one of the one or more LED strings.

16. The method of claim 11, wherein the generating of the control signal is initiated relative to a change in a second measurable parameter.

17. A liquid crystal display including a system for controlling one or more LED strings for backlighting comprising:

a detector coupled to one or more LED strings and configured for detecting an upper limit level for a triode region voltage range for a LED string;

a programmable decentralized controller associated with the detector that receives information from the detector associated with the upper limit level for the triode region voltage range; and based on the received information, generates a control signal indicative of a desired drive voltage level until receiving an indication from the detector that the upper limit level for the triode region voltage range meets a reference condition; and a power supply having power factor correction capability associated with the programmable decentralized controller, wherein the power supply:

receives the control signal as a first input and an AC voltage waveform as a second input; and generates a drive voltage waveform having the desired drive voltage level.

18. The liquid crystal display of claim 17, wherein the detector includes a detector for detecting an ambient temperature of a LED string.

19. The liquid crystal display of claim 17, wherein the control signal includes a current signal.

20. The liquid crystal display of claim 17, wherein the control signal includes a voltage signal.

* * * * *

UNITED STATES PATENT AND TRADEMARK OFFICE

CERTIFICATE OF CORRECTION

PATENT NO. : 8,314,572 B2
APPLICATION NO. : 12/409088
DATED : November 20, 2012
INVENTOR(S) : Matthew Schindler It is certified that error appears in the above-identified patent and that said Letters Patent is hereby corrected as shown below:

Drawing Sheet 7 of 12, please delete " 7~~8~~07 " and insert therefor -- 707 --; and Column 6, line 20, please delete "and or" and insert therefor -- and/or --.

Signed and Sealed this
Twelfth Day of February, 2013

Teresa Stanek Rea
*Acting Director of the United States Patent and Trademark Office*